US008997649B2

(12) United States Patent
Lee et al.

(10) Patent No.: US 8,997,649 B2
(45) Date of Patent: Apr. 7, 2015

(54) CLICHÉ FOR ELECTRONIC PRINTING DEVICE, AND ELECTRONIC PRINTING METHOD AND DEVICE USING THE SAME

(71) Applicant: Korea Institute of Machinery & Materials, Daejeon (KR)

(72) Inventors: Taik Min Lee, Daejeon (KR); In Young Kim, Daejeon (KR); Jeong Dai Jo, Daejeon (KR); Byung-Oh Choi, Daejeon (KR)

(73) Assignee: Korea Institute of Machinery & Materials, Daejeon (KR)

( * ) Notice: Subject to any disclaimer, the term of this patent is extended or adjusted under 35 U.S.C. 154(b) by 189 days.

(21) Appl. No.: 13/628,171

(22) Filed: Sep. 27, 2012

(65) Prior Publication Data

US 2013/0220153 A1 Aug. 29, 2013

(30) Foreign Application Priority Data

Feb. 23, 2012 (KR) ..... 10-2012-0018368

(51) Int. Cl.

| | |
|---|---|
| ***B41M 1/10*** | (2006.01) |
| ***B41N 1/00*** | (2006.01) |
| ***B41F 5/22*** | (2006.01) |
| ***B41F 9/01*** | (2006.01) |
| ***B41F 17/00*** | (2006.01) |

(52) U.S. Cl.

CPC .. *B41M 1/10* (2013.01); *B41N 1/00* (2013.01); *B41F 5/22* (2013.01); *B41F 9/01* (2013.01); *B41F 17/001* (2013.01)

(58) Field of Classification Search

CPC ..... B41F 9/061

USPC ..... 101/150, 163, 158; 977/887

See application file for complete search history.

(56) References Cited

U.S. PATENT DOCUMENTS

| | | | | |
|---|---|---|---|---|
| 6,943,117 | B2 * | 9/2005 | Jeong et al. | 438/694 |
| 2006/0060317 | A1 * | 3/2006 | Roding et al. | 162/135 |
| 2006/0210720 | A1 * | 9/2006 | Yoo | 427/428.01 |
| 2009/0283000 | A1 * | 11/2009 | Nomoto | 101/395 |
| 2010/0162910 | A1 | 7/2010 | Maim | |
| 2011/0023736 | A1 * | 2/2011 | Kim et al. | 101/158 |
| 2011/0159689 | A1 * | 6/2011 | Kim | 438/674 |

FOREIGN PATENT DOCUMENTS

| | | | | |
|---|---|---|---|---|
| DE | 102006024750 | A1 | 7/2007 | |
| GB | 2433724 | A | 7/2007 | |
| JP | 09129504 | A * | 5/1997 | B32B 18/00 |
| JP | 2005-205672 | | 8/2005 | |
| JP | 2005-310406 | | 11/2005 | |

(Continued)

*Primary Examiner* — Jill Culler
*Assistant Examiner* — Ruben Parco, Jr.
(74) *Attorney, Agent, or Firm* — Lexyoume IP Meister, PLLC

(57) ABSTRACT

The present invention relates to a cliché, and it particularly relates to a cliché with a partition formed thereon for controlling a blanket and the partition to be parallel with each other by the partition when a partition is protrusively formed on the cliché and the blanket is not combined with the cliché according to a predetermined method, controlling functional ink disposed between the blanket and the cliché to be transferred while not spreading so that it may be transferred to a substrate in a shape to be patterned when the blanket does not contact the cliché, and an electronic printing device and method using the same.

2 Claims, 9 Drawing Sheets

(56) References Cited

FOREIGN PATENT DOCUMENTS

| | | | |
|---|---|---|---|
| JP | 2005-354042 | | 12/2005 |
| JP | 2011-118346 | | 6/2011 |
| KR | 10-2006-001797 | | 1/2008 |
| KR | 10-2008-0075975 | | 8/2008 |
| KR | 10-2009-0119358 | | 11/2009 |
| KR | 10-2010-0009919 | | 1/2010 |
| KR | 10-0975094 | | 8/2010 |
| KR | 10-1091536 | | 12/2011 |
| KR | 10-1093075 | | 12/2011 |
| KR | 10-1094864 | | 12/2011 |
| WO | 2012-008686 | A2 | 1/2012 |

* cited by examiner

CLICHÉ FOR ELECTRONIC PRINTING DEVICE, AND ELECTRONIC PRINTING METHOD AND DEVICE USING THE SAME

CROSS-REFERENCE TO RELATED APPLICATION

This application claims priority to and the benefit of Korean Patent Application No. 10-2012-0018368 filed in the Korean Intellectual Property Office on Feb. 23, 2012, the entire contents of which are incorporated herein by reference.

BACKGROUND OF THE INVENTION (a) Field of the Invention

The present invention relates to a cliché, and it particularly relates to a cliché with a partition formed thereon for controlling a blanket and the partition to be parallel with each other by the partition when a partition is protrusively formed on the cliché and the blanket is not combined with the cliché according to a predetermined method, controlling functional ink disposed between the blanket and the cliché to be transferred while not spreading so that it may be transferred to a substrate in a shape to be patterned when the blanket does not contact the cliché, and an electronic printing device and method using the same.

(b) Description of the Related Art

In general, a cliché (CL, refer to FIG. 1) signifies a portion generated by taking off an unneeded pattern except a form that is generated when functional ink (I) contacts a coated blanket (B) and is patterned.

As shown in FIG. 1, a reverse gravure offset electronic printing device 10 will be exemplified.

The reverse gravure offset printing device 10 includes a blanket (B) on which functional ink (I) is applied, and a cliché (CL) contacting the blanket (B) and taking off an unneeded pattern.

That is, a blanket (B) on which functional ink (I) is coated is prepared.

The functional ink (I) can be applied to the blanket (B) by using a method such as spin coating or slit coating.

The blanket (B) on which functional ink (I) is applied contacts the cliché (CL) on which a recess CL1 is provided.

In this instance, the functional ink (I, I1) contacting the recess CL1 remains in the blanket (B) and the functional ink (I, I2) contacting a contact surface CL2 of the cliché (CL) is transferred to the cliché (CL).

That is, the part to be patterned remains in the blanket (B), it is transferred to a substrate (not shown), and a printing process is performed.

In addition, regarding the electronic printing field that has been recently highlighted, a width of the pattern is frequently less than several tens of um.

However, in the above-noted case of the electronic printing, the blanket (B) and the cliché (CL) are not combined according to a predetermined order but they frequently contact each other while slanted or curved.

In general, the cliché (CL) is made of a hard material such as glass or SUS and the blanket is made of elastic rubber so if they forcibly contact each other when the blanket (B) and the cliché (CL) are slanted or bent, the entire side to be printed can be contacted.

However, when too much force is applied to contact the blanket (B) and the cliché (CL), a fine pattern may be pressed and broken.

Therefore, it is important to make the blanket (B) and the cliché (CL) contact in parallel with each other so that they may not be slanted or bent.

However, the components such as the blanket (B) and the cliché (CL) have errors in their processing and assembling so there a limit in having them ideally contact each other in parallel.

For example, as shown in FIG. 2, when the slanted blanket (B) contacts the cliché (CL) as desired by the functional ink I and I4 disposed in the center of the drawing, the functional ink I, I3 does not contact the cliché (CL) as it goes to the left of the drawing and the functional ink I5, I6 excessively contacts the same while the blanket (B) is slanted as it goes to the right of the drawing so the pattern is damaged I, I6, the functional ink I, I5 is pushed and inserted into the recess CL1, and the pattern is transferred inaccurately.

The problem becomes worse as the area becomes wider and it becomes more important in the case of printing fine patterns.

Therefore, a fundamental solution for the printed portions to be parallel with each other while the components such as the blanket and the cliché are not generally in parallel is required so that the fine pattern may not receive an excessive force.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a cliché for forming a partition in a protruded manner on the cliché to allow regions (fine printing regions) where the blanket contacts the cliché to be parallel with each other by the partition when the blanket is not parallel with the cliché or they are a little bent so as to allow a precise electronic printing method, and an electronic printing device and method using the same.

A cliché according to the present invention for an electronic printing device for contacting a blanket to which a functional ink is applied and taking off an undesired pattern, comprises: a plate-shaped main body; a contact surface formed on one side of the main body and contacting the functional ink applied on the blanket; a pattern groove engraved in one side of the main body; and a partition protruded on a contact surface of both sides of the pattern groove.

An electronic printing device according to the present invention comprises: a blanket a surface of which functional ink is applied to; and a first cliché contacting the blanket surface and taking off an unneeded pattern of the functional ink, wherein the first cliché includes a first plate-shaped main body, a first contact surface formed on one side of the first main body and contacting the functional ink applied on the blanket surface, a first pattern groove engraved in one side of the first main body, and a partition protruded on a first contact surface of both sides of the first pattern groove.

An electronic printing method according to the present invention comprises: providing a blanket a surface of which functional ink is applied to; providing a first cliché including a first plate-shaped main body, a first contact surface formed on one side of the first main body and contacting functional ink applied on the blanket surface, a first pattern groove engraved in one side of the first main body, and a partition protruded on a first contact surface of both sides of the first pattern groove; contacting the blanket and the first cliché; and separating the blanket and the first cliché to transfer functional ink contacting the first contact surface to the first cliché and allowing functional ink contacting the first pattern groove to remain on the blanket.

According to the embodiments of the present invention, when the blanket does not contact the cliché according to a predetermined position, the regions (fine printing regions) where the blanket contacts the cliché are made parallel with each other by the partition thereby allowing a precise electronic printing process.

DETAILED DESCRIPTION OF THE EMBODIMENTS

Before explaining the current examples of the present modular outdoor playpen apparatus in detail, it is to be understood that the invention is not limited in its application to the details of construction and arrangements of the components set forth in the following description or illustration.

The invention is capable of other examples and of being practiced and carried out in various ways.

Also, it is to be understood that phraseology and terminology used herein with reference to device or element orientation (such as, for example, terms like "front", "back", "up", "down", "top", "bottom", "left", "lateral", and the like) are only used to simplify description of the present invention, and do not alone indicate or imply that the device or element referred to must have a particular orientation.

Prior to making the description, the terms or words used in the specification and claims of the present invention are not interpreted using typical or dictionary limited meanings, and are constructed as meanings and concepts conforming to the technical spirit of the present invention based on the principle that the inventors can appropriately define the concepts of the terms to explain the present invention in the best manner.

Accordingly, it is to be understood that the detailed description, which will be disclosed along with the accompanying drawings, is intended to describe the exemplary embodiments of the present invention and is not intended to represent all technical ideas of the present invention. Therefore, it should be understood that various equivalents and modifications can exist which can replace the embodiments described in the time of the application.

The present invention will now be described through the accompanying drawings and exemplary embodiments.

Exemplary Embodiment 1

Figure 3:
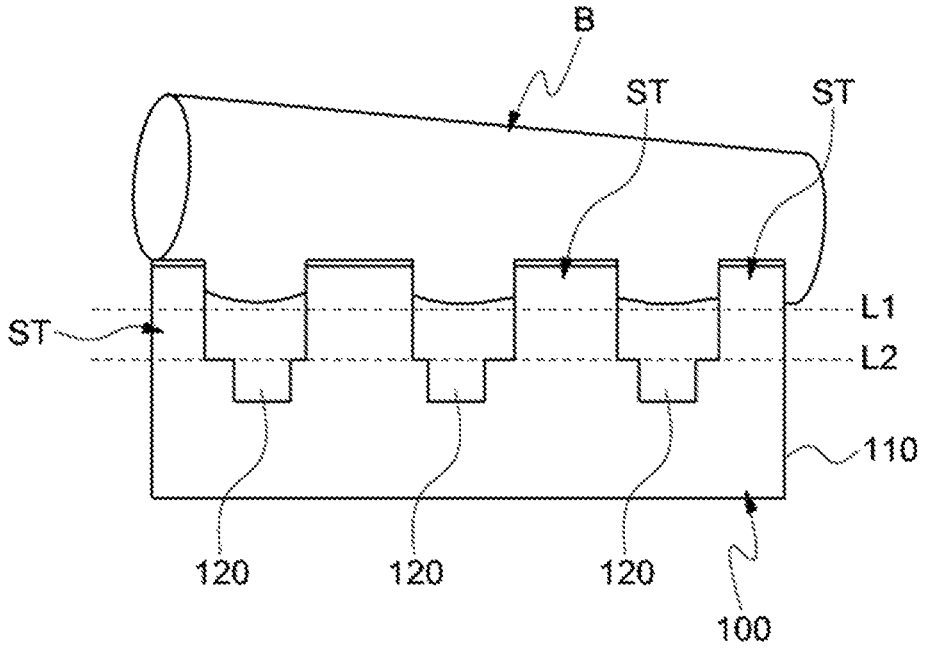
FIG. 3 shows a schematic view of a cliché according to a preferred embodiment of the present invention.

As shown in FIG. 3, the present invention provides a cliché 100 for contacting a blanket (B) on which functional ink (I) is applied and removing an unneeded pattern.

The cliché 100 includes a plate-type main body 110, a contact surface 111 formed on one side of the main body 110 and contacting functional ink applied to the blanket (B), a pattern groove 120 engraved in one side of the main body 110, and a partition (ST) protruded on the contact surface 111 on both sides of the pattern groove 120.

According to the above-noted configuration, when the blanket (B) and the cliché 100 are not combined at a normal position, the blanket (B) becomes parallel with the cliché 100 when the blanket (B) contacts the cliché 100, so the functional ink is not damaged by the conventional excessive contact and precise and fine printing is possible.

That is, as shown in FIG. 3, while the blanket (B) is relatively slanted with respect to the cliché 100 because of many reasons, they can contact each other.

The blanket (B) can contact the cliché 100 starting from its right portion as shown in the drawing.

In this instance, elasticity of the blanket (B) is deformed between the partition (ST), and a part of the surface of the deformed blanket (B) can be inserted between the partitions (ST).

That is, in FIG. 3, the right portion of the blanket (B) is inserted therebetween and the left portion thereof is then inserted therebetween, and in this instance, spaces between the blanket (B) and the cliché 100 after insertion can be substantially parallel with each other.

When the elasticity of the blanket (B) is deformed and a part of the surface of the deformed blanket (B) is inserted between the partitions (ST), a deformation amount of the partitions (ST) is increased as an insertion amount between the partitions (ST) is increased so resistance generated at the time of insertion between the partitions (ST) is also increased.

According to the above-noted phenomenon, when the blanket (B) is inserted to a predetermined depth (refer to L1 of FIG. 3), the blanket (B) is hardly deformed and is not inserted any longer.

In detail, the right portion of the blanket (B) is inserted in advance, and after the predetermined depth L1, it is hard for the blanket (B) to be deformed so it cannot be inserted therein, and during a delay of its insertion, the left portion of the blanket (B) is inserted therein with the depth L1.

Resultantly, when the blanket (B) does not normally (e.g., being slanted) contact the cliché 100, the blanket (B) is substantially parallel with the cliché 100.

That is, in FIG. 3, the blanket (B) is inserted to the dotted straight line L1, and it is substantially maintained parallel with the dotted line L2 that indicates the contact surface with the cliché 100.

The above-noted phenomenon seems to be caused by the fact that the blanket (B) is elastic and the slanting angle of the blanket (B) in the electronic printing field is very small.

In detail, FIG. 3 shows a conceptual diagram for describing a principle of the present invention, and in general, elastic materials such as a silicon blanket or rubber can be used for the blanket (B), and rigid materials such as glass, SUS, or nickel can be used for the cliché 100.

When the blanket (B) contacts the cliché 100 (e.g., while it is slanted as shown in FIG. 3) and a partition is formed on the cliché 100, the elastic blanket (B) is elastically deformed and it goes into the engraving of the cliché (i.e., between the partitions).

In this instance, the inner line L1 of the blanket (B) becomes close to being parallel with the cliché. That is, the principle used in this case is than a degree of parallelism between the blanket (B) and the cliché 100 was bad, but the partition (ST) receives a force for deformation and the degree of parallelism except the partition (ST), a portion to be printed, becomes better.

As described, according to the embodiment of present invention, when the entire side of the blanket (B) is slanted or bent, the space between the blanket (B) and the cliché 100, that is, the printing region, is substantially maintained to be parallel by the partition (ST).

Figure 1:
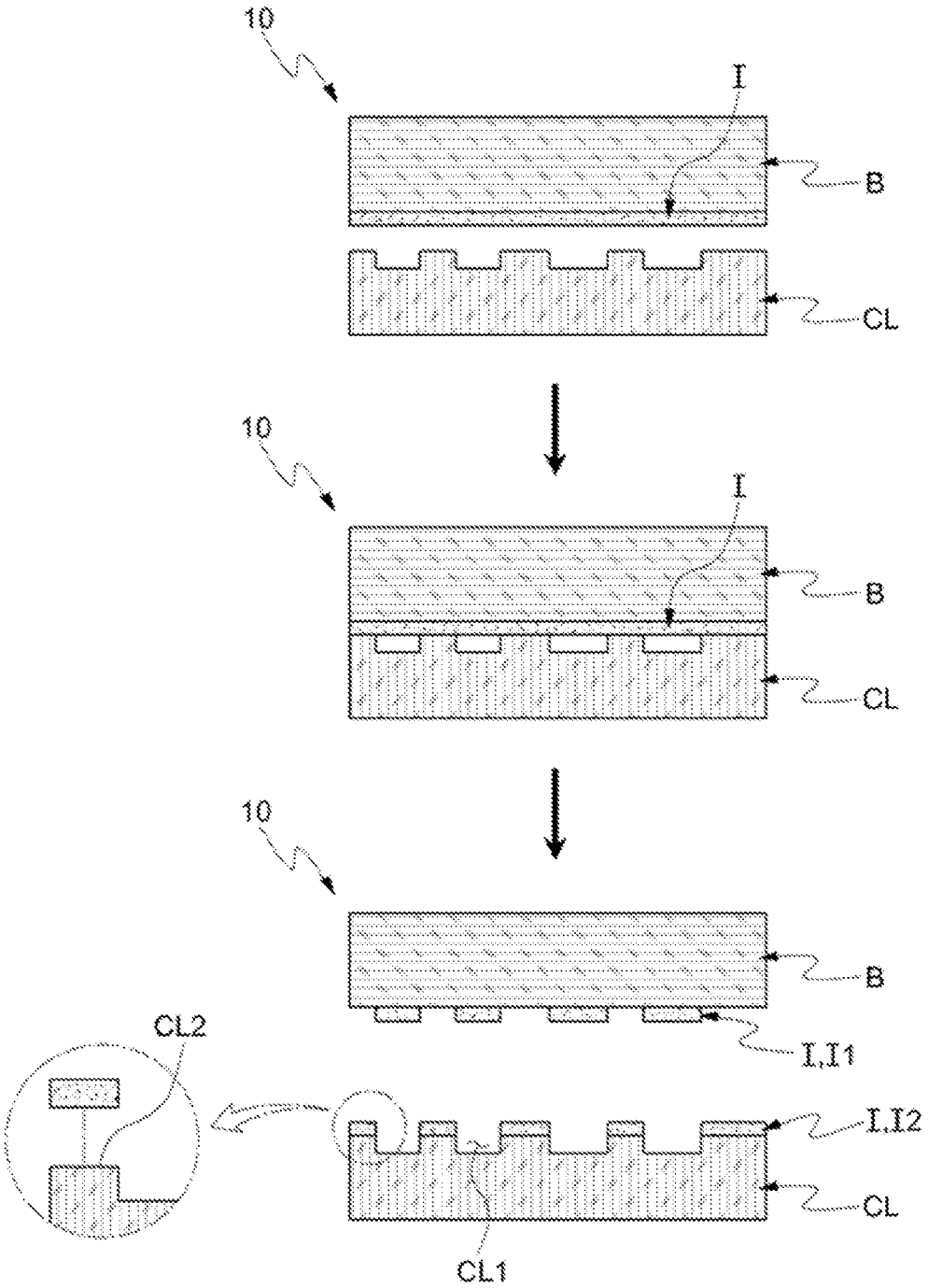
FIG. 1 (Prior Art)
FIG. 1 and FIG. 2 show schematic views of a conventional cliché.
Figure 2:
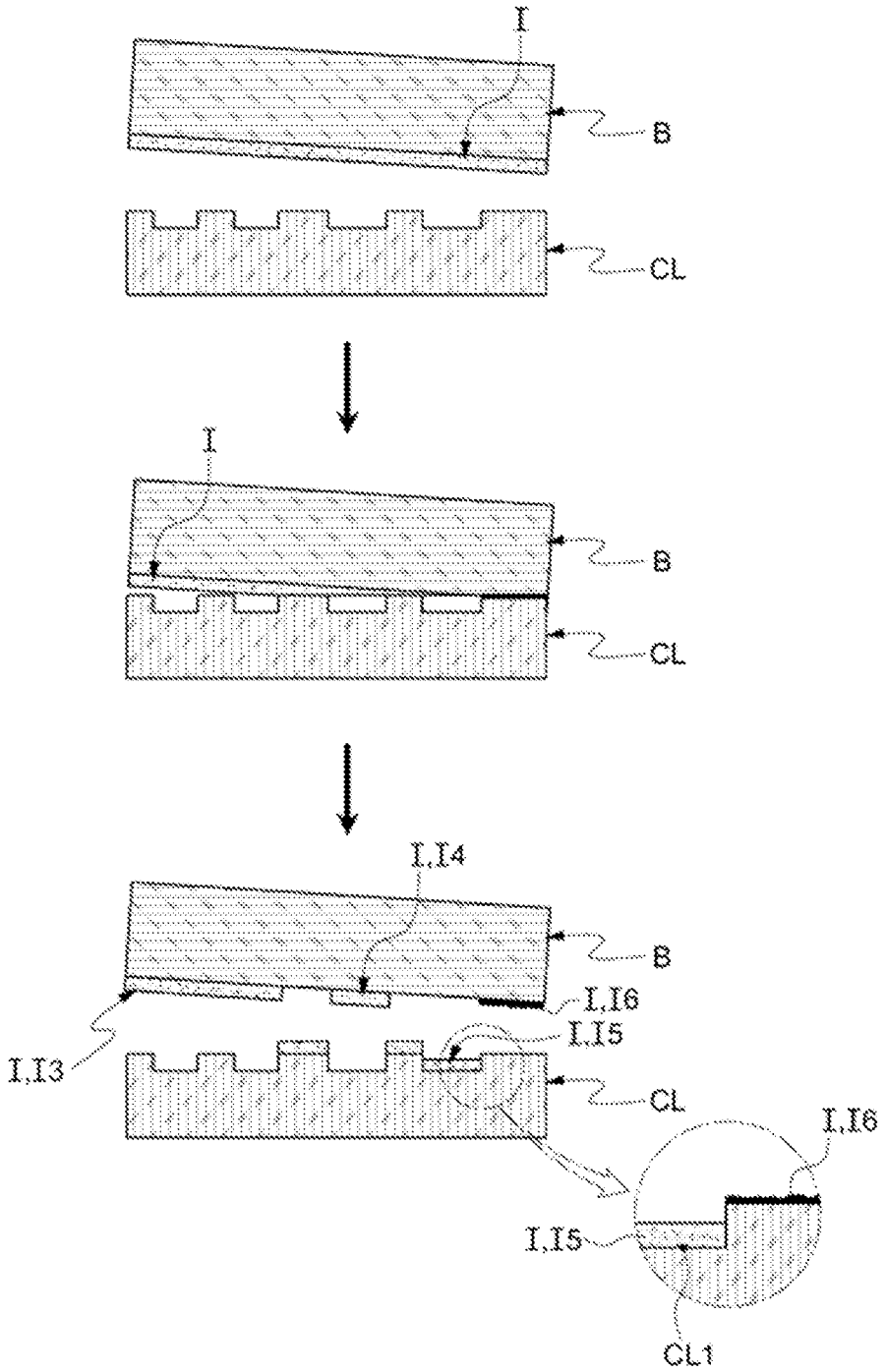
FIG. 2 (Prior Art)

Prior art has the problem in which the slanted blanket (B) excessively contacts the cliché so the pattern is damaged (refer to FIG. 2).

However, even when the slanted blanket (B) contacts the cliché according to the embodiment of the present invention, it contacts the cliché 100 in the parallel state by the partition (ST), thereby solving the problem of prior art.

In addition, the blanket (B) is not described but it can be a flat engraving plate in the case of flat plate printing, and it can be a pattern roller in the case of reverse gravure offset printing.

Also, a PDMS can be used for the material of the blanket (B), and various methods including spin coating and dip coating can be used so as to apply the functional ink (I) on the blanket (B).

In addition, any kinds of conductive materials available for realizing an electronic circuit to be printed are usable for the functional ink (I).

Exemplary Embodiment 2

As shown in FIG. 4A to FIG. 4F, the present invention discloses an electronic printing device 200 including a blanket (B) a surface of which functional ink (I) is applied to, and a first cliché 100 contacting the surface of the blanket (B) and removing an unneeded pattern of the functional ink (I).

In this instance, the cliché 100 includes a first plate-type main body 110, a first contact surface 111 formed on one side of the first main body 110 and contacting functional ink applied to the blanket (B), a first pattern groove 120 engraved in one side of the main body 110, and a partition (ST) protruded on the first contact surface 111 on both sides of the first pattern groove 120.

According to the above-noted configuration, when the blanket (B) contacts the cliché 100, the blanket (B) is substantially parallel with the cliché 100 so when the blanket (B) is slanted, functional ink contacting the contact surface 111 is taken off to the cliché 100 and the functional ink contacting the pattern groove 120 remains on the blanket (B).

That is, differing from prior art, when the blanket (B) contacts the cliché 100 while slanted, the blanket (B) is substantially parallel with the cliché 100 by the partition (ST), so the functional ink (I) does not excessively contact and is not spread so the pattern with a desired line width to be realized can be printed.

FIG. 4A to FIG. 4F show that the pattern groove 120 and the partition (ST) have a quadrangular cross-section.

However, the pattern groove 120 aims at not contacting the functional ink (I) of the blanket (B), and the partition (ST) aims at the blanket (B) being parallel with the cliché 100.

Therefore, within the range of the aim, other shapes of the pattern groove 120 and the partition (ST) are allowable in the present invention.

Figure 5A:
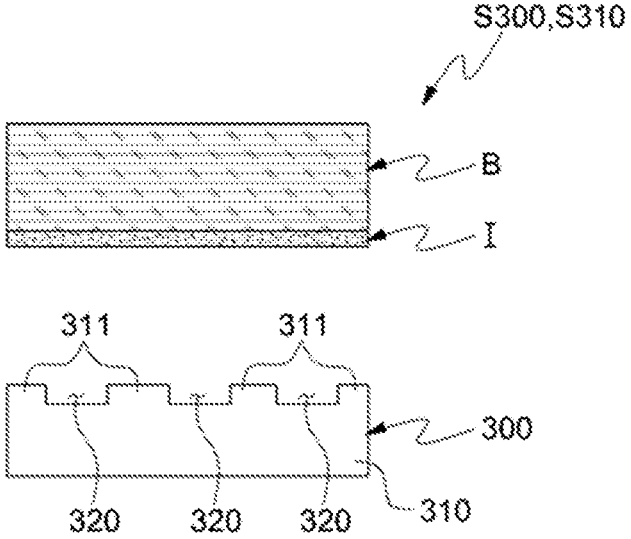
FIG. 5A to FIG. 5C show schematic views according to another exemplary embodiment of the present invention.
Figure 5B:
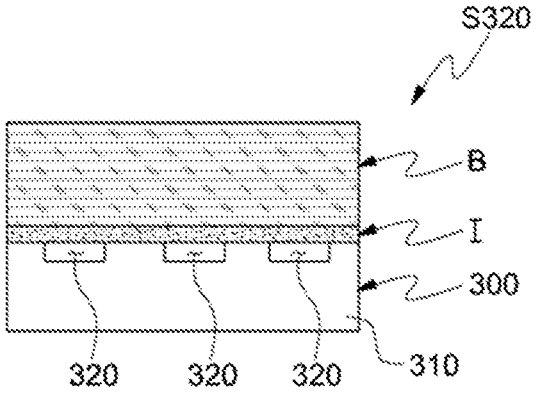
Figure 5C:
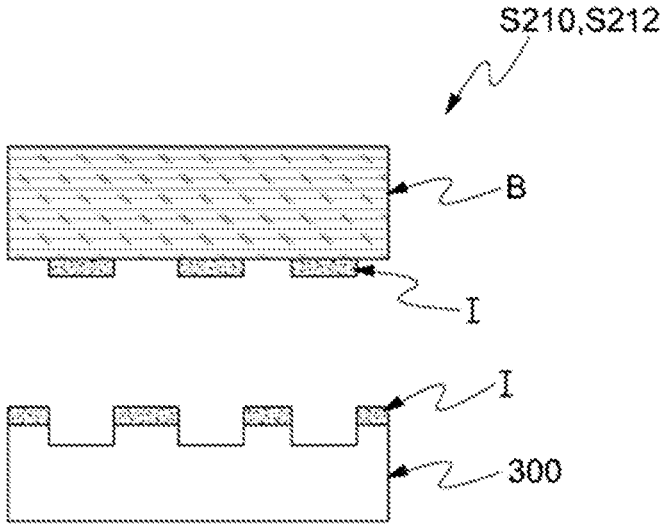

As shown in FIG. 5A to FIG. 5C, a second cliché 300 contacting the blanket (B) and taking off an unneeded pattern can be further included.

That is, the pattern that is not needed the first time is taken off by the second cliché 300 and the first cliché 100 is then used, which will be described in detail in Exemplary Embodiment 4.

The second cliché 300 removes the unneeded pattern the first time, and the conventional cliché can be used.

Figure 6:
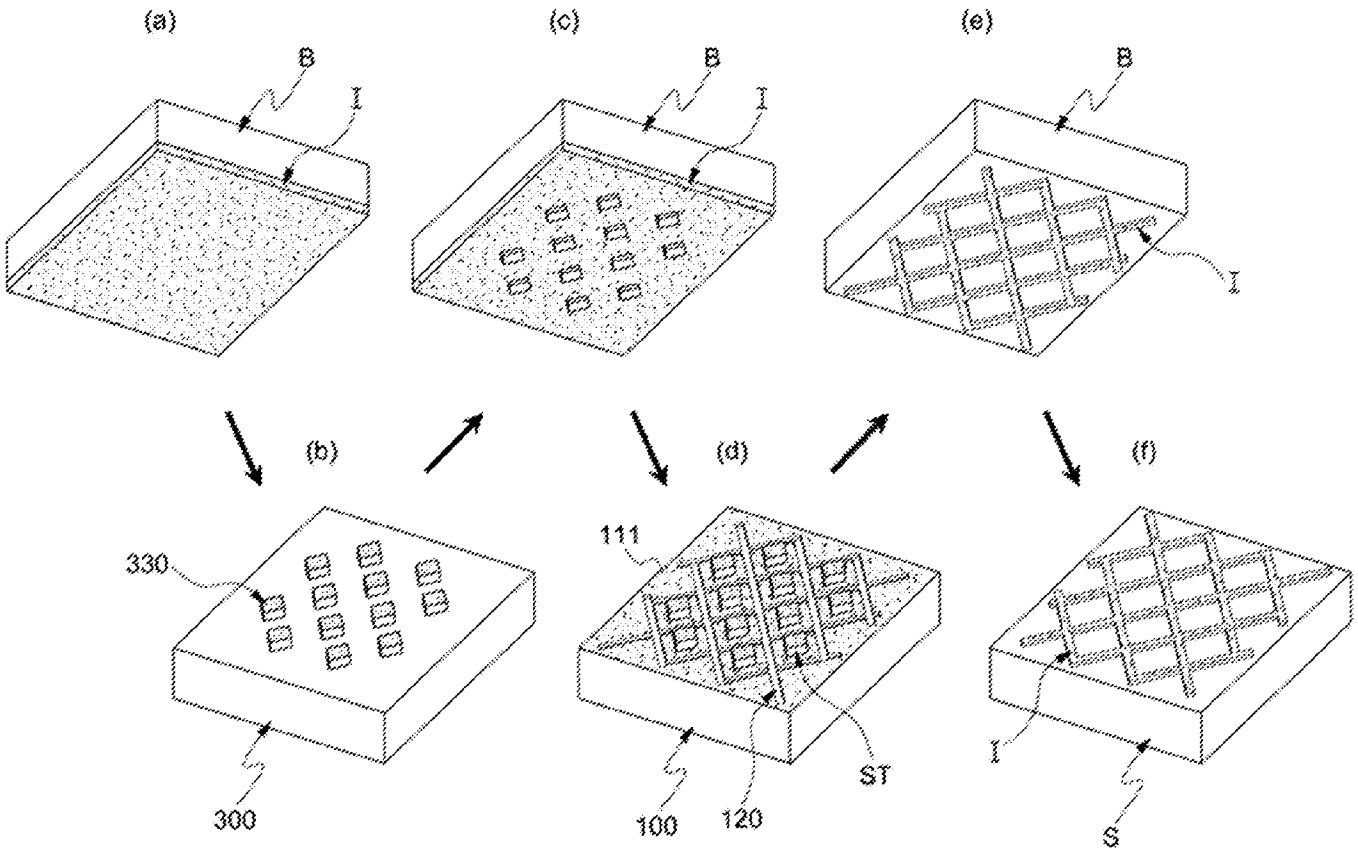
FIG. 6 shows a perspective view of a printing device and method according to a preferred embodiment of the present invention.

Further, as shown in FIG. 6, the partition (ST) can be formed in a lattice shape on the first contact surface 111 so that they may be separated with a constant gap, and the first pattern groove 120 can have a mesh shape in which a plurality of line shapes between the partitions (ST) cross each other, which will be described in Exemplary Embodiment 5.

Exemplary Embodiment 3

The present invention represents a printing method using the above-described electronic printing device 200 (S200) (refer to FIG. 4A to FIG. 4F.)

Figure 4A:
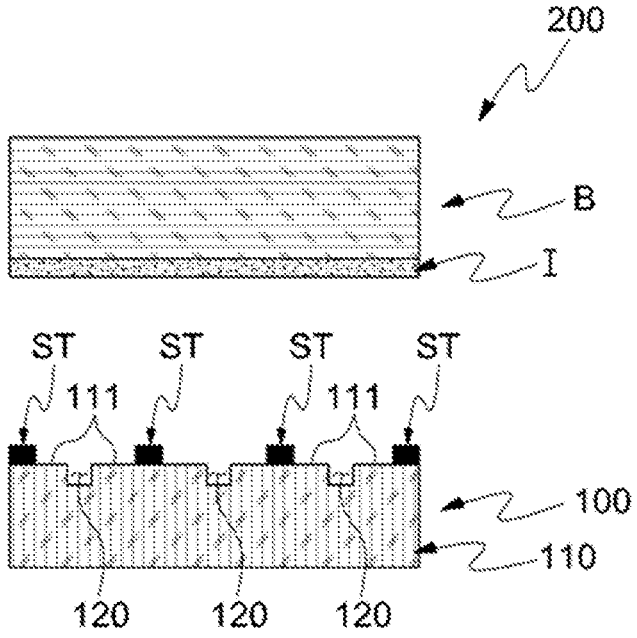
FIG. 4A to FIG. 4F show schematic views for a printing device and method according to a preferred embodiment of the present invention.
Figure 4B:
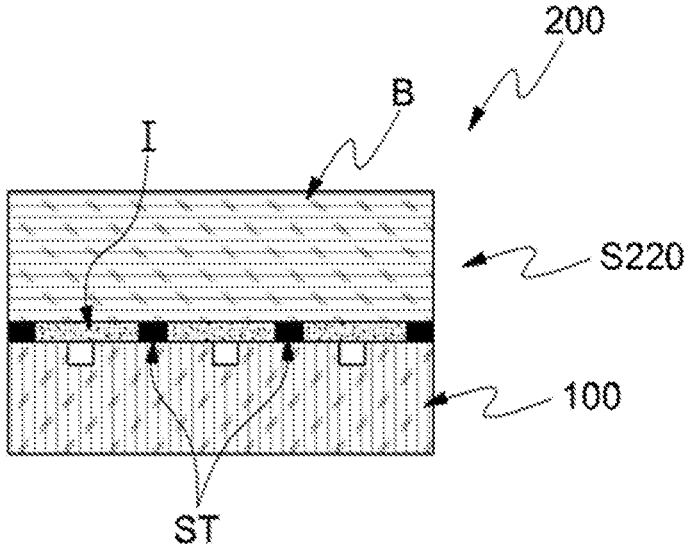

The method (S200) includes allowing the blanket (B) the surface of which the functional ink (I) is applied to to contact the first cliché 100, and controlling the functional ink (I) disposed between the partitions (ST) to not be spread to both sides by the partition (ST) to thus performs a second stage (S220) (refer to FIG. 4B).

That is, when the conventional cliché contacts the blanket, the functional ink (I) disposed between them is spread (refer to FIG. 2).

However, according to the embodiment of the present invention, when the blanket (B) is slanted, the blanket (B) is substantially parallel with the first cliché 100 by the partition (ST) so the functional ink does not spread to both sides.

Figure 4C:
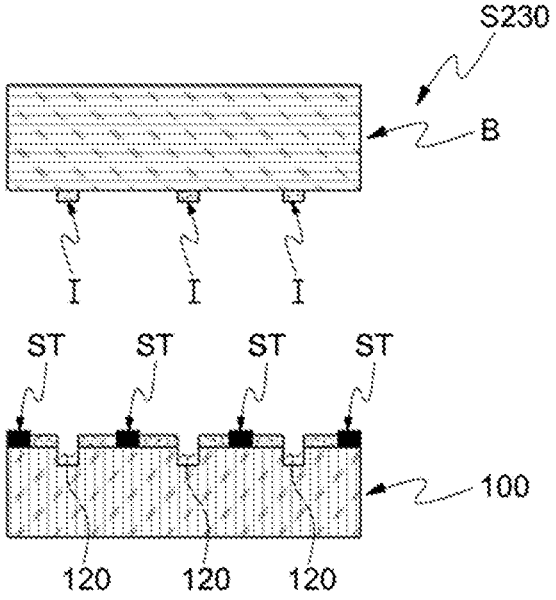

After the second stage S220 is performed, the functional ink (I) separating the blanket (B) and the cliché 100 and contacting the first contact surface 111 of the first cliché 100 is transferred to the first cliché 100, and the functional ink (I) contacting the first pattern groove 120 performs a third stage (S230) to remain in the blanket (B) (refer to FIG. 4C).

In this instance, when the slanted blanket (B) contacts the cliché 100, the blanket (B) and the cliché 100 are substantially parallel with each other so the functional ink (I) is transferred to the blanket (B) according to the desired pattern.

Figure 4D:
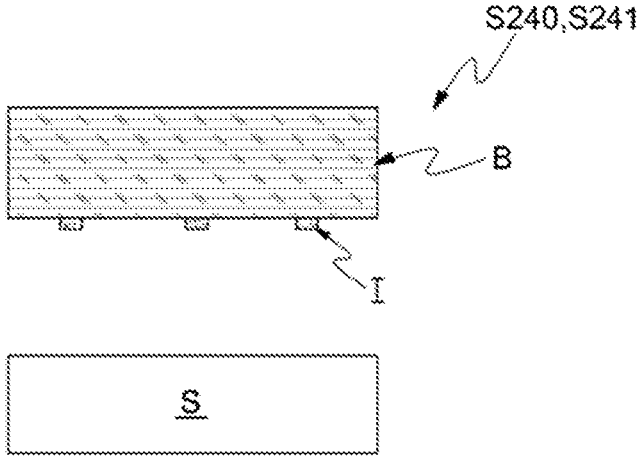
Figure 4E:
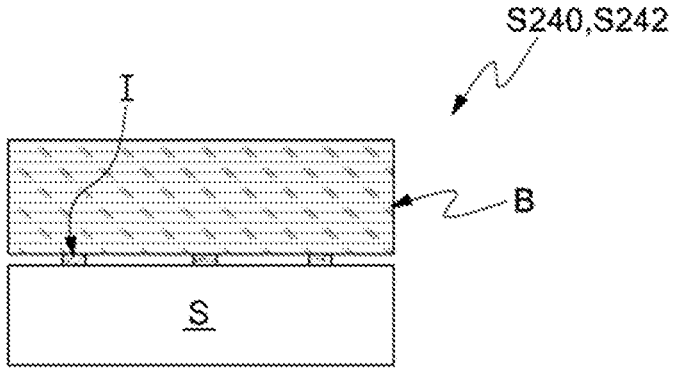
Figure 4F:
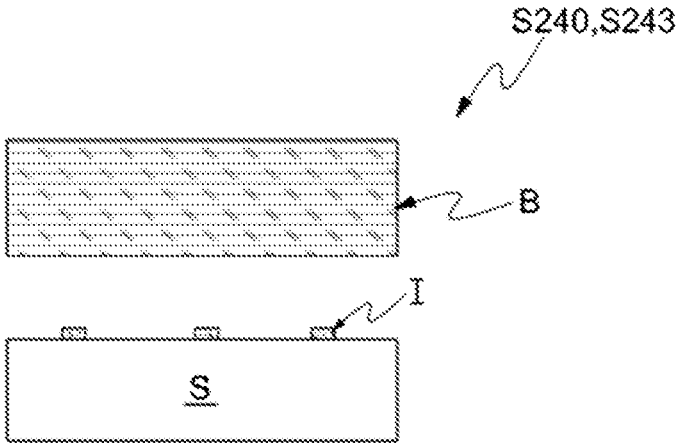

After the third stage S230 is performed, the blanket (B) is controlled to contact a substrate (S) to transfer the functional ink (I) remaining on the blanket (B) to the substrate (S), thereby performing a fourth stage S240 (refer to FIG. 4D to FIG. 4F).

For this, a forty-first stage S241 for disposing the blanket (B) on which the pattern to be printed remains on the substrate (S) according to the third stage S230 is performed (refer to FIG. 4D).

After the forty-first stage S241 is performed, a forty-second stage S242 for contacting the blanket (B) and the substrate (S) is performed (refer to FIG. 4E).

After the forty-second stage S242 is performed, a forty-third stage S243 for separating the blanket (B) and the substrate(S) and transferring the functional ink (I) to the substrate (S) is performed (refer to FIG. 4F).

According to the embodiment of the present invention, precise electronic printing is possible even when the blanket (B) does not accurately contact the first cliché 100 at a predetermined position.

In this instance, before the second stage S220 is performed, it is possible to further include a first stage S210 for applying the functional ink (I) on the blanket (B).

Exemplary Embodiment 4

The present invention represents another printing method S300 using the electronic printing device 200 (refer to FIG. 5A to FIG. 5C)

The method S300 performs a first stage S310 for contacting the blanket (B) on which the functional ink (I) is applied and a second cliché 300 to take off the unneeded pattern before contacting the blanket and the first cliché (refer to FIG. 5A).

That is, as shown in FIG. 5A, the second cliché 300 is contacted with the blanket (B) on which the conductive ink (I) is applied to take off the unneeded pattern for the first time.

In this instance, the conventional cliché can be used for the second cliché 300.

The pattern removed for the first time is generally not minute so it can be taken off by using the existing method.

That is, the second cliché 300 includes a plate-type second main body 310, a second contact surface 311 formed on one side of the second main body 310 and contacting the conductive ink (I) applied on the surface of the blanket (B), and a second pattern groove 320 engraved in one side of the second main body, and conductive ink contacting the contact surface 311 is removed by the second cliché 300 and the conductive ink contacting the pattern groove 320 can remain on the blanket (B) (refer to FIG. 5B and FIG. 5C).

After the first stage S310 is performed, the blanket (B) is controlled to contact the cliché 100, and the functional ink (I) disposed between the partitions (ST) is controlled to not be spread on both sides by the partition (ST) to thus perform the second stage S320, which corresponds to the second stage (S220, refer to FIG. 4B) of Exemplary Embodiment 3 so no repeated description will be provided.

The blanket (B) is separated from the first cliché 100 so that the functional ink (I) contacting the first contact surface 111 of the first cliché 100 is transferred to the first cliché 100, and the functional ink (I) contacting the first pattern groove 120 remains on the blanket (B) thereby performing the third stage S330. The blanket (B) is controlled to contact the substrate (S) to transfer the functional ink (I) remaining on the blanket (B) to the substrate (S), thereby performing the fourth stage S340.

The third stage S330 corresponds to the third stage (S230, FIG. 4C) of Exemplary Embodiment 3 and the fourth stage S340 corresponds to the fourth stage (S240, FIG. 4D to FIG. 4F) of Exemplary Embodiment 3 so repeated description will be omitted.

Exemplary Embodiment 5

As shown in FIG. 6, the partition (ST) can be formed to have a lattice shape on the first cliché 100 so that they may be separated by a predetermined gap.

Also, the first pattern groove 120 can have a mesh shape in which a plurality of line shapes are formed between the partitions (ST) and cross each other.

Also, the second cliché 300 can include a protrusion 330 protruded on the second cliché 300 and removing the functional ink (I) applied on the blanket (B).

A method for forming a mesh-shaped pattern including the above-noted configuration will now be described.

The blanket (B) (FIG. 6 (*a*)) to which functional ink (I) is applied is controlled to contact the second cliché (300, FIG. 6 (*b*)).

In this instance, functional ink (I) contacting the protrusion 330 of the second cliché 300 is taken off to the second cliché 300 and another portion thereof remains on the blanket (B) (FIG. 6C).

The blanket (B) shown in FIG. 6 (*c*) is controlled to contact the first cliché (100, FIG. 6 (*d*)). In this instance, the first pattern groove 120 can be provided to contact the blanket (B) where the functional ink (I) remains.

The partitions (ST) of the first cliché 100 can be formed to be separated from each other in the lattice shape on the first cliché 100 as described.

Further, the first pattern grooves 120 of the first cliché 100 are formed as a plurality of line shapes between the partitions (ST), and can have a mesh shape crossing each other.

In this instance, functional ink (I) contacting the first pattern groove 120 remains on the blanket (B) so its form also remains as a mesh shape (FIG. 6 (*e*)).

In addition, conductive ink (I) contacting the first contact surface 111 of the first cliché 100 is taken off to the first cliché 100.

In this instance, when the blanket (B) shown in FIG. 6 (*e*) contacts the substrate (S), conductive ink (I) in the mesh shape remaining on the blanket (B) is transferred to the substrate (S) and the pattern printing is finished.

Particularly, when the blanket (B) contacts the first cliché 100 by the partition (ST) formed on the first cliché 100 while slanted, the problem of damaging the pattern by excessive contact is not generated so a precise and fine pattern can be printed.

What is claimed is:

1. An electronic printing method comprising:

providing a blanket a surface of which functional ink is applied to;

providing a first cliché including a first plate-shaped main body, a first contact surface formed on one side of the first main body and contacting functional ink applied on the blanket surface, a first pattern groove engraved in one side of the first main body, and a partition protruded on a first contact surface of both sides of the first pattern groove;

providing a second cliché including a second plate-shaped main body, a second contact surface formed on one side of the second main body and contacting the functional ink applied on the blanket surface, and a second pattern groove engraved in one side of the second main body;

contacting the blanket and the second cliché;

separating the blanket and the second cliché to transfer functional ink contacting the second contact surface to the second cliché and allowing functional ink contacting the second pattern groove to remain on the blanket;

contacting the blanket and the first cliché; and separating the blanket and the first cliché to transfer functional ink contacting the first contact surface to the first cliché and allowing functional ink contacting the first pattern groove to remain on the blanket.

2. The electronic printing method of claim 1, wherein the contacting of the blanket and the first cliché includes contacting the first pattern groove and the blanket on which the functional ink remains.

* * * * *